US005088137A

United States Patent [19]

Rose

[11] Patent Number: 5,088,137

[45] Date of Patent: Feb. 18, 1992

[54] BACKBOARD HAVING REMOVABLE PAD

[76] Inventor: Eric R. Rose, 6677 Suzanne La., San Bernardino, Calif. 92404

[21] Appl. No.: 710,067

[22] Filed: Jun. 4, 1991

[51] Int. Cl.[5] ..... A61G 1/04; A61G 1/044

[52] U.S. Cl. ..... 5/625; 128/870

[58] Field of Search ..... 5/82 R, 411; 128/870, 128/871, 876

[56] References Cited

U.S. PATENT DOCUMENTS

| | | | |
|---|---|---|---|
| 3,566,422 | 3/1971 | Klippel | 5/82 R |
| 3,659,297 | 5/1972 | Schultz | 5/465 |
| 3,707,734 | 1/1973 | Matthews | 5/82 R |
| 4,143,654 | 3/1979 | Sherman . | |
| 4,205,669 | 6/1980 | Hamann | 128/870 |
| 4,220,147 | 9/1980 | Allen, III | 128/75 |
| 4,299,211 | 11/1981 | Doynow | 128/870 |
| 4,336,621 | 6/1982 | Schwartz et al. | 5/411 |
| 4,369,982 | 1/1983 | Hein et al. | 5/82 R |
| 4,506,664 | 3/1985 | Brault | 5/82 R |
| 4,519,106 | 5/1985 | Sandquist | 5/82 R |
| 4,528,981 | 7/1985 | Behar | 5/437 |
| 4,655,206 | 4/1987 | Moody | 5/82 R |
| 4,679,260 | 7/1987 | Frettem | 5/82 R |
| 4,895,173 | 1/1990 | Brault et al. | 128/870 |
| 4,899,736 | 2/1990 | Nesbitt | 128/870 |
| 4,928,360 | 5/1990 | Wilbanks | 5/82 R |

FOREIGN PATENT DOCUMENTS 2928629 1/1981 Fed. Rep. of Germany ..... 5/82 R

*Primary Examiner*—Alexander Grosz
*Attorney, Agent, or Firm*—Sheldon & Mak

[57] ABSTRACT

Disclosed is backboard apparatus for supporting a patient. The apparatus includes a board having top and bottom surfaces, a plurality of side pairs of slots formed in an edge extremity of the board; and a pad assembly connected to the board including a pad having bottom and top surfaces bounded by sides and ends of the pad, and a first strap connected to the pad, having free ends extending beyond the sides of the pad and a fastener for connecting the ends to form a first closed loop, extending through a side pair of the slots and under the bottom surface of the board for securing the pad to the board. The apparatus can include a plurality of the first straps spaced apart on the pad. The board can include an additional pair of the slots located proximate end portions of the edge extremity, the apparatus including a pair of end straps connected to the pad for preventing longitudinal movement between the pad and the board. The pad can include a foam core and a cover, the core being formed of polyurethane or polyvinyl chloride. The pad assembly can be provided for use with a separate spine board.

23 Claims, 1 Drawing Sheet

BACKBOARD HAVING REMOVABLE PAD

BACKGROUND

The present invention relates to emergency care and transportation of trauma patients, especially in case of spinal injuries, and in situations requiring patient immobilization.

Equipment for transportation of injured patients commonly includes a tub-shaped basket stretcher which can have a pad or mattress removably secured therein, and a rigid spine board onto which the patient can be secured in appropriate cases, the patient being subsequently moved, together with the spine board, into the stretcher. Conventional spine boards of the prior art are fabricated from a substantially rectangular panel, typically of plywood, having a plurality of slots formed therethrough proximate opposite side edges of the panel. The slots serve as handles for carrying the patient, and as anchors for straps that secure the patient to the board. Typically, the spine boards have an additional one pair or a pair of the slots proximate each end of the board.

A problem with the conventional equipment of the prior art is that it is often desirable to provide padded support for the patient. While it is known to provide basket stretchers with a pad or mattress, such mattresses would be unsuitable for use on a spine board, in that the mattress would block or restrict access to the side slots of the board. Also, the conventional equipment is awkward to use in that the existing mattresses have no convenient attachment to the spine board, and because the securing straps, being loose items, are difficult to manipulate while holding the patient (and the mattress) on the board. Moreover, the straps are easily lost.

Thus there is a need for spine board apparatus that avoids the above disadvantages.

SUMMARY

The present invention is directed to a backboard apparatus for supporting an injured patient that meets this need. The apparatus includes a rigid substantially rectangular board member having opposite, substantially planar top and bottom supportive surfaces, a plurality of elongate slots being formed in spaced relation to a peripheral edge extremity of the board, the slots being located in aligned side pairs along opposite side portions of the edge extremity; and a pad assembly removably connected to the board member, the pad assembly including a pad member having a bottom surface supported by the board member and a top surface for supporting the patient, the top and bottom surfaces being bounded by opposite sides and ends of the pad member; and first strap means connected to the pad member and having free ends extending beyond opposite sides of the pad member, the free ends of the first strap means having fastener means for adjustably connecting the free ends to form a first closed loop, the free ends extending downwardly through corresponding ones of a side pair of the slots, and under a portion of the bottom supportive surface of the board member for securing the pad member to the board member.

The apparatus can include a plurality of the first strap means for forming a corresponding number of the first closed loops, the first strap means being spaced apart on the pad member for alignment of each of the first straps with a corresponding side pair of the slots. Each of the first strap means can include a first strap member having the free ends, the first strap member being connected to the pad member proximate the opposite sides thereof. Each of the first strap means comprises a pair of first strap portions, the first strap portions being anchored to the pad member proximate the opposite sides thereof.

The board member can include an additional end pair of the slots located proximate opposite end portions of the edge extremity, the apparatus further including a pair of end strap portions connected to the pad member, free ends of the respective end strap portions having fastener means for adjustably connecting the free ends of the end strap portions to form a closed loop, the end strap portions extending downwardly through corresponding ones of the end slots, and under a portion of the bottom supportive surface of the board member for securing the pad member to the board member, and for preventing longitudinal movement therebetween.

The pad member can include a core portion, and a cover portion enclosing the core portion, the core portion being formed of foam. The core portion can be formed of polyurethane or polyvinyl chloride. At least some of the first strap means can be divided, a pair of end segments of each first strap means being separately connected to the cover portion of the pad member. The strap end portions can extend from the cover portion at locations approximately midway between the top surface and the bottom surface of the cover member.

Preferably the first strap means extends outwardly from the slots, under the bottom supporting surface of the board member, the first closed loop extending opposite the pad member from the board member for securing a patient, together with the pad member, to the board member. The apparatus can further include second strap means connected to the pad member and having free ends extending beyond opposite sides of the pad member and through the side pair of the slots and under portions of the bottom supportive surface of the board member, the second strap means forming a second closed loop, the second closed loop extending opposite the pad member from the board member for securing a patient, together with the pad member, to the board member.

In another aspect of the present invention, a pad apparatus is provided for use with a rigid rectangular spine board having top and bottom supportive surfaces and a peripheral edge extremity, a plurality of elongate slots forming spaced pairs of openings between the top and bottom supportive surfaces and located proximate opposite side portions of the edge extremity, the pad apparatus including the pad member, and the first strap means located on the pad member in alignment with the pair of the slots of the spine board for securing the pad member to the board member between the pair of slots. The apparatus can include the plurality of the first strap means for forming a corresponding number of the first closed loops, the first strap means being spaced apart on the pad member for alignment of each of the first straps with a corresponding side pair of the slots. The apparatus can further include second strap means connected to the pad member and having free ends extending beyond opposite sides of the pad member and through the side pair of the slots and under portions of the bottom supportive surface of the board member, the second strap means forming a second closed loop, the second closed loop extending opposite the pad member from the board member for securing a patient, together with the pad member, to the board member.

DRAWINGS

These and other features, aspects, and advantages of the present invention will become better understood with reference to the following description, appended claims, and accompanying drawings, where:

Figure 1:
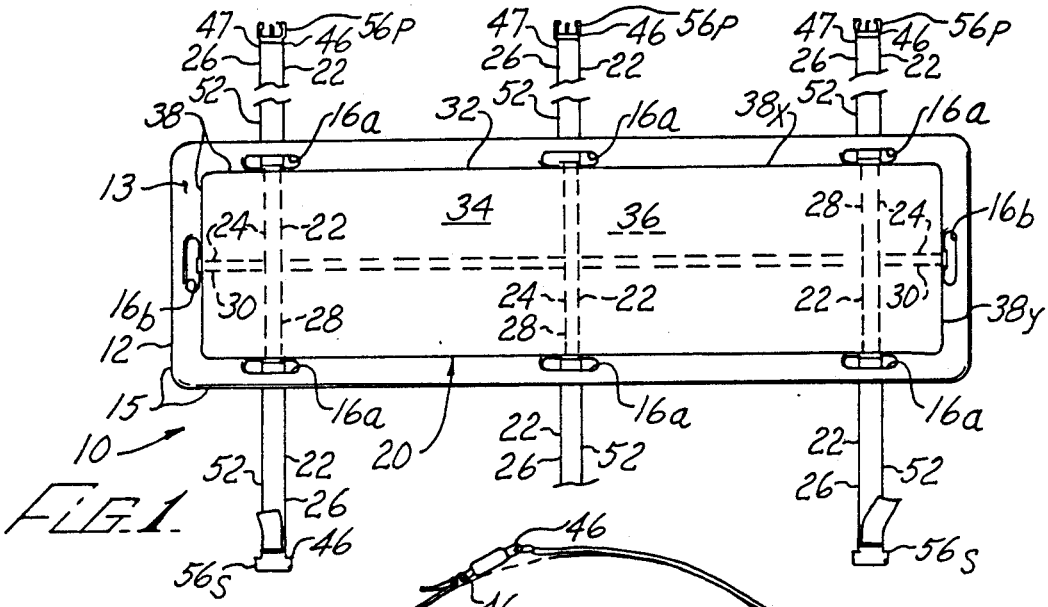
FIG. 1 is a top plan view of padded spine board apparatus according to the present invention.
Figure 3:
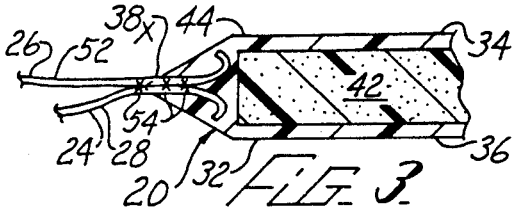
Figure 4:
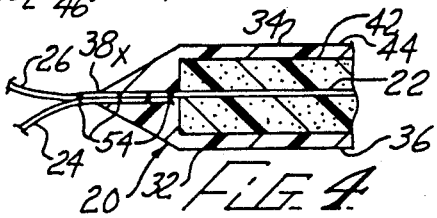

FIG. 3 a fragmentary sectional detail view of a portion of the apparatus of FIG. 1;

FIG. 4 is a detail view as in FIG. 3, showing an alternative configuration of the apparatus of FIG. 3.

DESCRIPTION

Figure 2:
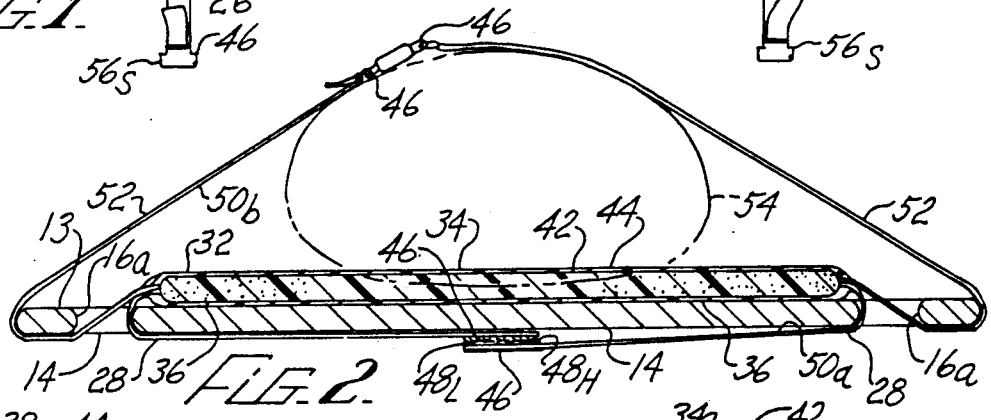
FIG. 2 is a lateral sectional elevational view of the apparatus of FIG. 1.

The present invention is directed to improved spine board apparatus for emergency care and transportation of trauma patients. With reference to FIGS. 1–3 of the drawings, a padded spine board apparatus 10 includes a conventional spine board 12, the board 12 having a parallel spaced pair of generally rectangular supportive surfaces, designated top board surface 13 and bottom board surface 14, the surfaces 13 and 14 being bounded by an edge extremity 15 of the board 12. The board 12 is formed with a plurality of pairs of openings or slots 16 between the surfaces 13 and 14 and uniformly spaced from the opposite portions of the extremity 15, the openings 16 being designated side slots 16*a* and end slots 16*b*. According to the present invention, a pad assembly 20 is supported on the top surface 13 of the board 12 and removably affixed thereto by a plurality of straps 22 that form a portion of the pad assembly 20. In an exemplary configuration of the pad assembly 20, there are two groups of the straps 22, designated first strap set 24 and second strap set 26, the first set 24 including a plurality of first side strap pairs 28 and a pair of end straps 30. A rectangular pad member 32 of the pad assembly 20 forms generally planar top and bottom pad surfaces 34 and 36, and a perimeter margin 38, the margin 38 having opposite portions designated side margin $38_X$ and end margin $38_Y$. The pad member 32 includes a resilient core member 42, the core member 42 being enclosed by a flexible cover member 44. Each of the straps 22 is fixably connected to the pad member 32 at its perimeter margin 38, buckle means 46 being provided proximate a free end 47 of each strap 22.

As best shown in FIG. 2, pairs of hook-loop fasteners, designated hook fastener $48_H$ and loop fastener $48_L$, form the buckle means 46 of the first strap set 24, the strap ends 47 being joined under the bottom board surface 14 and forming first closed loops 50*a* for holding the bottom surface 36 of the pad member 32 in place against the top board surface 13, the straps 22 passing through and engaging the slots 16. In particular, the first side straps 28 protrude the side slots 16*a*, and the end straps 30 protrude the end slots 16*b* as shown in FIG. 1.

As further shown in the drawings, the second strap set 26 includes a plurality of second side strap pairs 52, the straps 22 of the pairs being connected to the pad member 32 in superposition with the straps 22 of the first side strap pairs 28 of the first strap set 24. The second strap pairs 52 also extend through corresponding ones of the slots 16*a*, contacting portions of the bottom board surface 14, and forming second closed loops 50*b* for further securing the pad member 32 to the spine board 12 and, more importantly, for securing and restraining a patient 54 against the top pad surface 34. As shown in the drawings, the second side strap pairs are adjustably terminated by mating pairs of buckle members 56, designated plug member $56_P$ and socket member $56_S$.

As shown in FIG. 3, the straps 52 of the second strap set 26 are anchored by being molded within the cover member 44 proximate the side margin $38_X$, together with the straps 28 of the first strap set 24, the respective straps 28 and 52 being fastened together by stitching or other conventional means as indicated at 54.

With further references to FIG. 4, an alternative configuration of the pad assembly 20 has at least one of the straps 22 extending between the opposite side margins $38_X$ for transmitting tension loading of the straps 22 between opposite sides of the pad member 32.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. A backboard apparatus for supporting an injured patient, comprising:

(a) a rigid substantially rectangular board member having opposite, substantially planar top and bottom supportive surfaces, a plurality of elongate slots being formed in spaced relation to a peripheral edge extremity of the board, the slots being located in aligned side pairs along opposite side portions of the edge extremity; and (b) a pad assembly removably connected to the board member, the pad assembly comprising:

(i) a pad member having a bottom surface supported by the board member and a top surface for supporting the patient, the top and bottom surfaces being bounded by opposite sides and ends of the pad member; the pad member substantially covering the top surface of the board member between the side pairs of the slots; and (ii) first strap means connected to member and having free ends extending beyond opposite sides of the pad member, the free ends of the first strap means having fastener means for adjustably connecting the free ends to form a first closed loop, the loop extending downwardly through corresponding ones of a side pair of the slots, and under a portion, of the bottom supportive surface of the board member between the slots for securing the pad member to the board member

2. The apparatus of claim 1, comprising a plurality of the first strap means for forming a corresponding number of the first closed loops, the first strap means being spaced apart on the pad member for alignment of each of the first strap means with a corresponding side pair of the slots.

3. The apparatus of claim 2, wherein each of the first strap means comprises a first strap member having the free ends, the first strap member being connected to the pad member proximate the opposite sides thereof.

4. The apparatus of claim 2, wherein each of the first strap means comprises a pair of first strap portions, the first strap portions being anchored to the pad member proximate the opposite sides thereof.

5. The apparatus of claim 1, wherein the board member comprises an additional end pair of the slots located proximate opposite end portions of the edge extremity, the apparatus further comprising a pair of end strap portions connected to the pad member, free ends of the respective end strap portions having fastener means for adjustably connecting the free ends of the end strap portions to form a closed loop, the end strap portions extending downwardly through corresponding ones of the end slots, and under a portion of the bottom supportive surface of the board member for securing the pad member to the board member, and for preventing longitudinal movement therebetween.

6. The apparatus of claim 1, wherein the pad member comprises a core portion, and a cover portion enclosing the core portion, the core portion being formed of foam.

7. The apparatus of claim 6, wherein the core portion is formed of polyurethane.

8. The apparatus of claim 6, wherein the cover portion is formed of polyvinyl chloride.

9. The apparatus of claim 6, wherein at least some of the first strap means are divided, a pair of end segments of each first strap means being separately connected to the cover portion of the pad member.

10. The apparatus of claim 9, wherein the strap end portions extend from the cover portion at locations approximately midway between the top surface and the bottom surface of the cover member.

11. The apparatus of claim 1, further comprising second strap means connected to the pad member and having free ends extending beyond opposite sides of the pad member and through the side pair of the slots and under portions of the bottom supportive surface of the board member, the second strap means forming a second closed loop, the second closed loop extending opposite the pad member from the board member for securing a patient, together with the pad member, to the board member.

12. A pad apparatus for use with a rigid rectangular spine board member having top and bottom supportive surfaces and a peripheral edge extremity, a plurality of elongate slots forming spaced pairs of openings between the top and bottom supportive surfaces and located proximate opposite side portions of the edge extremity, the apparatus comprising:

(a) a pad member having a bottom surface for support by the board member and a top surface for supporting the patient, the top and bottom surfaces being bounded by opposite sides and ends of the pad member;

(b) first strap means for connecting the pad member to the board member, the first strap means being connected to the pad member and having free ends extending beyond opposite sides of the pad member, the free ends of the first strap means having fastener means for adjustably connecting the free ends to form a first closed loop, the first strap means being located on the pad member in alignment with a side pair of the slots of the spine board whereby the loop extends downwardly through corresponding ones of the slots, and under a portion of the bottom supportive surface of the board member between the slots for securing the pad member to the board member; and (c) a pair of end strap portions connected to the pad member, free ends of the respective end strap portions having fastener means for adjustable connecting the free ends of the end strap portions to form a second closed loop, the second closed loop extending downwardly and under a portion of the bottom supporting surface of the spine board for securing the pad member to the spine board, and for preventing longitudinal movement therebetween.

13. The apparatus of claim 12, comprising a plurality of the first strap means for forming a corresponding number of the first closed loops, the first strap means being spaced apart on the pad member for alignment of each of the first straps with a corresponding side pair of the slots.

14. The apparatus of claim 13, wherein each of the first strap means comprises a first strap member having the free ends, the first strap member being connected to the pad member proximate the opposite sides thereof.

15. The apparatus of claim 13, wherein each of the first strap means comprises a pair of first strap portions, the first strap portions being anchored to the pad member proximate the opposite sides thereof.

16. The apparatus of claim 12, wherein the board member comprises an additional end pair of the slots located proximate opposite end portions of the edge extremity, the second closed loop extending downwardly through the end slots.

17. The apparatus of claim 12, wherein the pad member comprises a core portion, and a cover portion enclosing the core portion, the core portion being formed of foam.

18. The apparatus of claim 17, wherein the core portion is formed of polyurethane.

19. The apparatus of claim 17, wherein the cover portion is formed of polyvinyl chloride.

20. The apparatus of claim 17, wherein at least some of the first strap means are divided, a pair of end segments of each first strap means being separately connected to the cover portion of the pad member.

21. The apparatus of claim 20, wherein the strap end portions extend from the cover portion at locations approximately midway between the top surface and the bottom surface of the cover member.

22. The apparatus of claim 12, wherein the first strap means extends outwardly from the slots, under the bottom supporting surface of the board member, the first closed loop extending opposite the pad member from the board member for securing a patient, together with the pad member, to the board member.

23. The apparatus of claim 12, further comprising second strap means connected to the pad member and having free ends extending beyond opposite sides of the pad member and through the side pair of the slots and under portions of the bottom supportive surface of the board member, the second strap means forming a second closed loop, the second closed loop extending opposite the pad member from the board member for securing a patient, together with the pad member, to the board member.

* * * * *